US010060161B2

(12) United States Patent
Shen

(10) Patent No.: US 10,060,161 B2
(45) Date of Patent: Aug. 28, 2018

(54) INNER OPERATING DEVICE FOR A DOOR LOCK

(71) Applicant: I-Ting Shen, Tainan (TW)

(72) Inventor: I-Ting Shen, Tainan (TW)

( * ) Notice: Subject to any disclaimer, the term of this patent is extended or adjusted under 35 U.S.C. 154(b) by 137 days.

(21) Appl. No.: 15/346,968

(22) Filed: Nov. 9, 2016

(65) Prior Publication Data

US 2018/0106077 A1 Apr. 19, 2018

(30) Foreign Application Priority Data

Oct. 19, 2016 (TW) ..... 105133624 A

(51) Int. Cl.

| | |
|---|---|
| ***E05B 65/10*** | (2006.01) |
| ***E05B 41/00*** | (2006.01) |
| ***E05B 45/06*** | (2006.01) |
| ***E05B 47/00*** | (2006.01) |

(52) U.S. Cl.

CPC ..... *E05B 65/108* (2013.01); *E05B 41/00* (2013.01); *E05B 45/06* (2013.01); *E05B 47/0012* (2013.01); *E05B 65/1046* (2013.01); *E05B 65/1053* (2013.01); *E05B 65/1086* (2013.01); *E05B 65/1093* (2013.01); *E05B 2045/065* (2013.01); *E05B 2045/0625* (2013.01); *E05B 2045/0695* (2013.01); *E05B 2047/0084* (2013.01)

(58) Field of Classification Search

CPC ..... E05B 41/00; E05B 45/06; E05B 45/12; E05B 45/125; E05B 2045/0615; E05B 2045/0625; E05B 2045/0635; E05B 2045/0695; E05B 2045/065; E05B 2045/0665; E05B 2045/067; E05B 2045/0675; E05B 65/10; E05B 65/102; E05B 65/1046; E05B 65/1053; E05B 65/108; E05B 65/1086

See application file for complete search history.

(56) References Cited

U.S. PATENT DOCUMENTS

| | | | | |
|---|---|---|---|---|
| 5,517,176 A * | 5/1996 | Lavelle | E05B 65/1046 | 292/92 |
| 5,525,880 A * | 6/1996 | Geringer | E05B 17/22 | 318/446 |
| 6,715,225 B1 * | 4/2004 | Frolov | E05B 65/1053 | 292/336.3 |
| 7,051,560 B2 * | 5/2006 | Sanchirico, Jr. | E05B 65/108 | 292/92 |

(Continued)

*Primary Examiner* — Christopher J Boswell
(74) *Attorney, Agent, or Firm* — Alan D. Kamrath; Kamrath IP Lawfirm, P.A.

(57) ABSTRACT

An inner operating device for a door lock is mounted to an inner side of a door and includes a first detecting member electrically connected to an electric driving device. A second detecting member is mounted in a latch device of the door lock. When the first detecting member detects an external force applied to the inner operating device, the electric driving device is activated, and the latch is moved to the unlatching position. When the latch device is set to be in a locked state or an unlocked state, the second detecting device outputs a signal to a lighting device to emit light for indicating the locked or unlocked state. In another example, the lighting device emits light of a first color when the latch device is in the locked state and emits light of a second color when the latch device is in the unlocked state.

12 Claims, 9 Drawing Sheets

(56) References Cited

U.S. PATENT DOCUMENTS

| | | | | |
|---|---|---|---|---|
| 7,862,091 | B2 * | 1/2011 | Escobar | E05B 47/023 292/201 |
| 8,182,003 | B2 * | 5/2012 | Dye | E05B 47/0012 292/216 |
| 8,851,530 | B2 * | 10/2014 | Geringer | E05B 47/0012 292/144 |
| 8,978,305 | B2 * | 3/2015 | Morstatt | E05B 47/026 292/144 |
| 2016/0017641 | A1 * | 1/2016 | Lin | E05B 65/104 292/92 |
| 2016/0230423 | A1 * | 8/2016 | Lehner, Jr. | E05B 65/1046 |
| 2016/0319570 | A1 * | 11/2016 | Wong | E05B 43/005 |

* cited by examiner

INNER OPERATING DEVICE FOR A DOOR LOCK

BACKGROUND OF THE INVENTION

The present invention relates to an inner operating device for a door lock and, more particularly, to an inner operating device mounted to an inner side of a door for moving a latch between a latching position and an unlatching position.

A type of door lock (so-called panic exit door lock) is mounted to a passageway door or a panic exit door. The panic exit door lock includes an outer operating device mounted to an outer side of a door and an inner operating device mounted to an inner side of the door. The inner operating device is generally of a type different from the outer operating device. The panic exit door device further includes a latch device including a latch movable between a latching position outside of the door and an unlatching position retracted into the door. The door lock can be set to be in a locked state or an unlocked state through an outer cylinder of the outer operating device or an inner cylinder of the inner operating device.

If the door lock is set to be in the unlocked state, the latch can be moved from the latching position to the unlatching position by operating either of the outer operating device and the inner operating device, thereby opening the door. If the door lock is set to be in the locked state, the latch cannot be moved from the latching position to the unlatching position when the outer operating device is operated, avoiding opening of the door by operating the outer operating device. This prevents a burglar from intruding from the outer side of the door into the inner side of the door. However, for emergency exit, the panic exit door lock must permit a user to easily use the inner operating device to move the latch from the latching position to the unlatching position no matter in the locked or unlocked state. Namely, the door has to be easily opened from the inside no matter the door lock is in the locked or unlocked state.

Since the panic exit door lock is so set that the inner operating device can be operated to open the door no matter in the locked or unlocked state, in a case that the user is at the inner side of the door while the panic exit door lock is set to be in the locked state, the user cannot confirm whether the panic exit door lock is actually in the locked state by operating the inner operating device, resulting in inconvenience in use. Furthermore, the inner operating device of the panic exit door lock has a complicated mechanical structure and, thus, has high manufacturing costs.

BRIEF SUMMARY OF THE INVENTION

In an aspect, an inner operating device is provided for a door lock including a latch device mounted in a compartment of a door. The latch device includes a latch movable between a latching position and an unlatching position, with the latch device further including a locking member movable between a locking position and a releasing position. The latch is movable from the latching position to the unlatching position when the locking member is in the releasing position. The latch is prevented from moving from the latching position to the unlatching position when the locking member is in the locking position.

The inner operating device includes a body adapted to be mounted to an inner side of the door. The body includes a first section and a second section. The first section includes a first space in an inner side thereof and a first engaging portion formed in the first space. The second section includes a second space. An electric driving device is received in the first space of the body and, is mounted to the first engaging portion. The electric driving device is configured to be operably connected to the latch of the latch device. A first detecting member is mounted in the second space of the body and is electrically connected to the electric driving device. A second detecting member is configured to be mounted in the latch device. The locking member presses against the second detecting member when the locking member is in one of the releasing state and the locking state. The locking member does not pressing against the second detecting member when the locking member is in the other of the releasing state and the locking state. An operating member is mounted in the second space of the body and is partially exposed outside of the second section. The operating member includes a groove. The operating member abuts the first detecting member. A lighting device is received in the groove of the operating member. The lighting device is electrically connected to the second detecting member.

When the operating member is not pressed by an external force, the operating member does not press against the first detecting member, the electric driving device is not activated, and the latch remains in the latching position.

When the operating member is pressed by an external force, the operating member presses against the first detecting member, the electric driving device is activated, and the latch is moved from the latching position to the unlatching position.

When the locking member is in the locking state, the lighting device is in one of a first state emitting light and a second state not emitting light. When the locking member is in the releasing state, the lighting device is in the other of the first state emitting light and the second state not emitting light.

In another aspect, an inner operating device is provided for a door lock including a latch device mounted in a compartment of a door. The latch device includes a latch movable between a latching position and an unlatching position. The latch device further includes a locking member movable between a locking position and a releasing position. The latch is movable from the latching position to the unlatching position when the locking member is in the releasing position. The latch is prevented from moving from the latching position to the unlatching position when the locking member is in the locking position.

The inner operating device includes a body adapted to be mounted to an inner side of the door. The body includes a first section and a second section. The first section includes a first space in an inner side thereof and a first engaging portion formed in the first space. The second section includes a second space. An electric driving device is received in the first space of the body and is mounted to the first engaging portion. The electric driving device is configured to be operably connected to the latch of the latch device. A first detecting member is mounted in the second space of the body and is electrically connected to the electric driving device. A second detecting member is configured to be mounted in the latch device. The locking member presses against the second detecting member when the locking member is in one of the releasing state and the locking state. The locking member does not pressing against the second detecting member when the locking member is in the other of the releasing state and the locking state. An operating member is mounted in the second space of the body and is partially exposed outside of the second section. The operating member includes a groove. The operating member abuts the first detecting member. A lighting device is received in the groove of the operating member. The lighting device is electrically connected to the second detecting member.

When the operating member is not pressed by an external force, the operating member does not press against the first detecting member, the electric driving device is not activated, and the latch remains in the latching position.

When the operating member is pressed by an external force, the operating member presses against the first detecting member, the electric driving device is activated, and the latch is moved from the latching position to the unlatching position.

When the locking member in the locking state, the lighting device emits light of a first color. When the locking member in the releasing state, the lighting device emits light of a second color different from the first color.

In an example, the first detecting member is a pressure sensor.

In an example, the second section of the body includes a first opening intercommunicated with the second space and a second opening spaced from the first opening. The operating member is located in the first opening. The inner operating device further includes a broadcasting device mounted in the second space of the body and located in the second opening. The broadcasting device is configured to be electrically connected to an anti-theft device. When the anti-theft device is activated, the broadcasting device generates an audio alarm. When the anti-theft device is not activated, the broadcasting device does not generate the audio alarm.

In an example, the operating member includes two hooked portions on an outer periphery thereof. Each of the two hooked portions engages with the first opening of the body.

In an example, the inner operating device further incudes a driving member coupled with the electric driving device. The driving member includes a releasing end and a driving end. The electric driving device is operably connected to the latch via the driving member. The electric driving device drives the driving end of the driving member to move the latch from the latching position to the unlatching position or driving the releasing end of the driving member to move the latch from the unlatching position to the latching position.

In an example, the first section of the body further includes a second engaging portion intercommunicated with the first space. The inner operating device further includes an inner cylinder having an inner lock core and an inner actuating member fixed to the inner lock core to move therewith. The inner lock core is configured to be in a first mode in which the inner lock core is locked and fixed or a second mode in which the inner lock core is unlocked and rotatable. The inner actuating member is jointly movable with the locking member. When the inner lock core is unlocked, the inner actuating member is permitted to actuate the locking member to move between the locking position and the releasing position.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
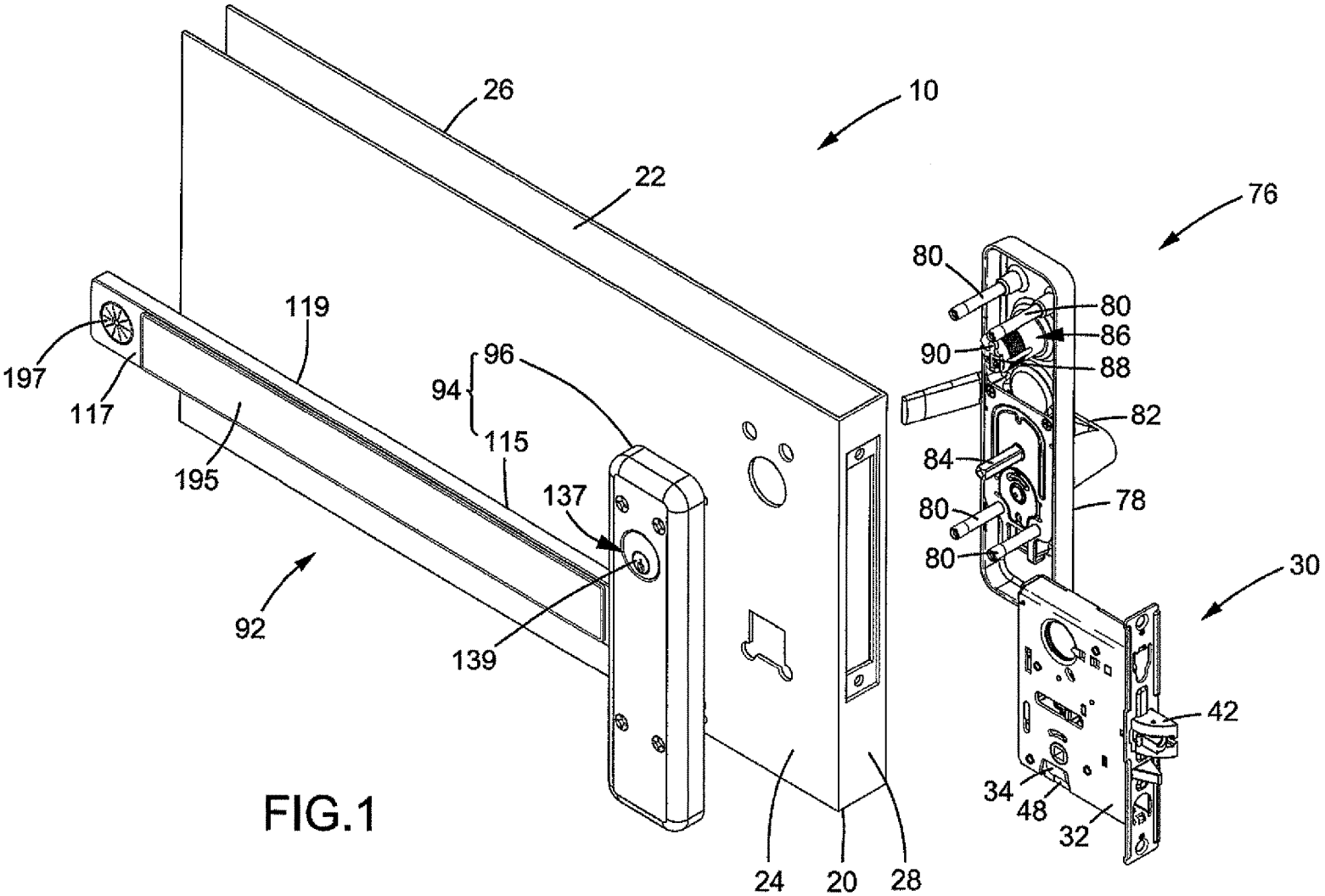
FIG. 1 is an exploded, perspective view of a door lock utilizing an inner operating device according to the present invention.
Figure 2:
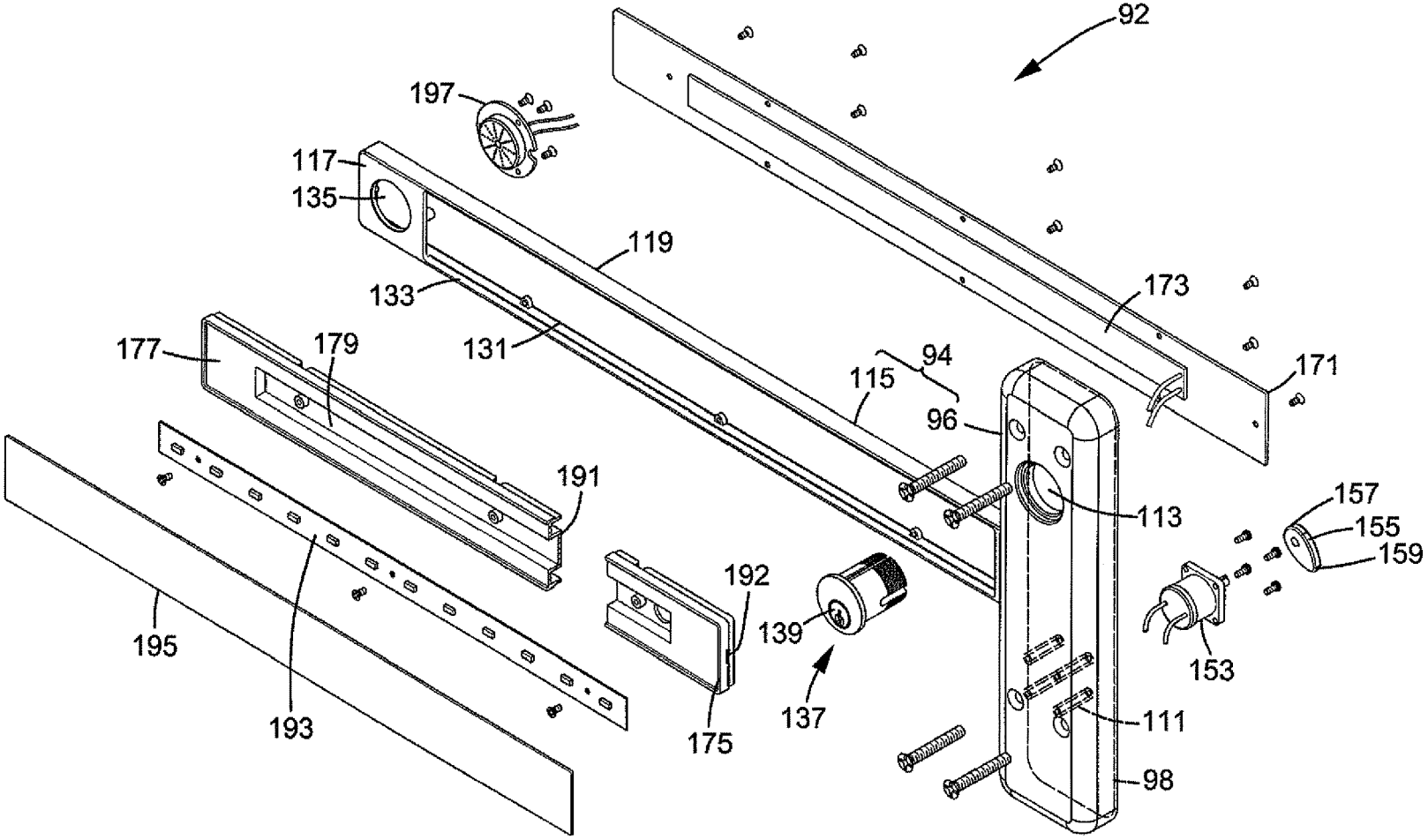
FIG. 2 is an exploded, perspective view of the inner operating device of FIG. 1.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "bottom", "side", "end", "portion", "section", "horizontal", "vertical", "spacing", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

With reference to the drawings, a door lock 10 is mounted to a door 20 including an inner side 24, an outer side 26 opposite to the inner side 24, and a compartment 22 defined between inner side 24 and outer side 26. Door 20 further includes an end face 28 extending between inner side 24 and outer side 26 and having an opening intercommunicated with compartment 22.

Door lock 10 includes a latch device 30 mounted to door 20. Latch device 30 includes a casing 32 fixed to end face 28 of door 20 and extending through the opening of end face 29. First, second, and third pivotal portions 36, 38, and 40 are disposed in casing 32. Second pivotal portion 38 is located between first pivotal portion 36 and third pivotal portion 40 in a vertical direction. Casing 32 includes an opening 34 below first pivotal portion 36.

Figure 8:
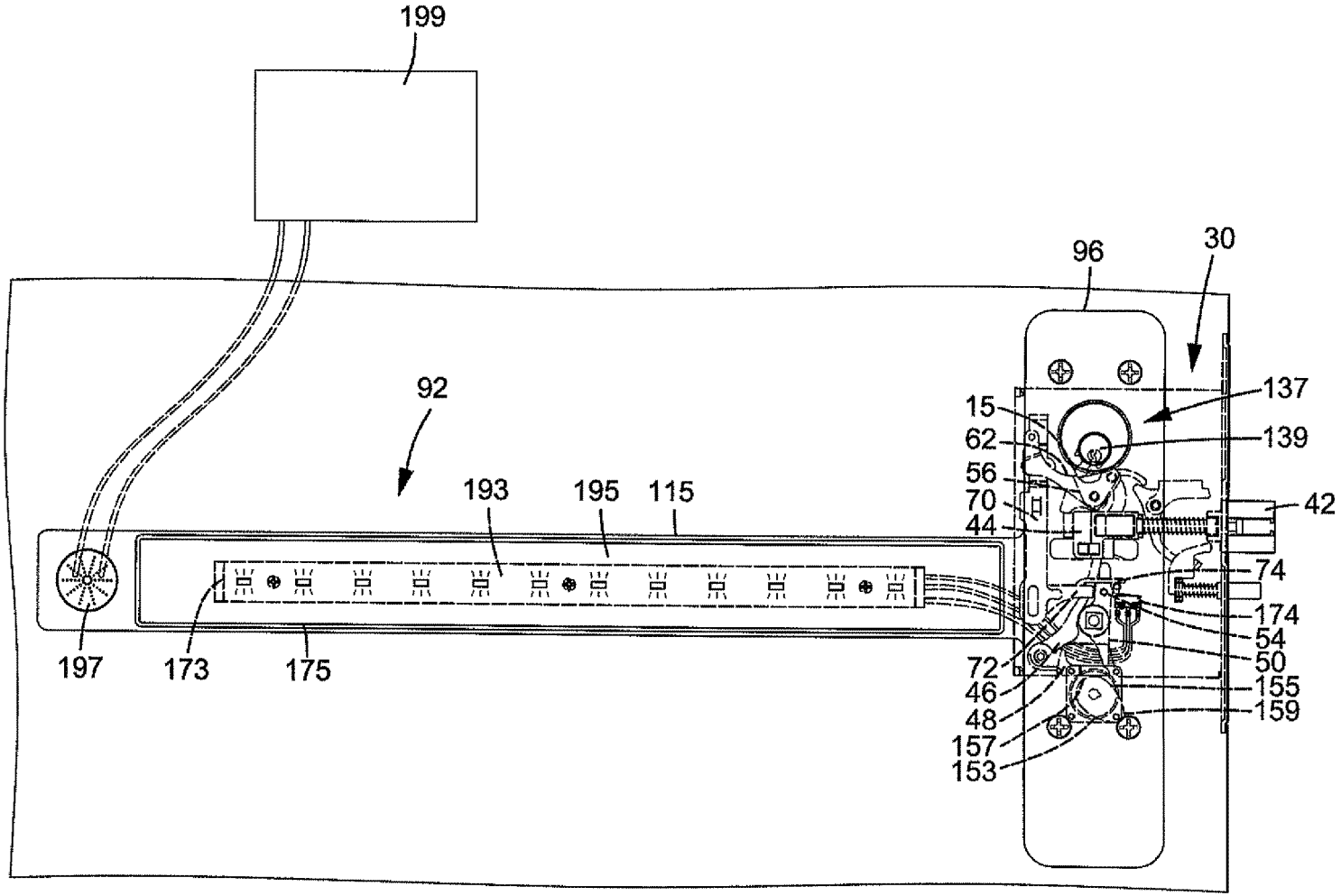
FIG. 8 is a view similar to FIG. 3, with a locking member moved to a locking position and with a lighting device emitting light.

Latch device 30 further includes a latch 42 mounted to casing 32 and slideable in a horizontal direction perpendicular to the vertical direction. Latch device 30 further includes a retractor 44 coupled with latch 42 to move therewith. Latch 42 and retractor 44 are movable in the vertical direction between second and third pivotal portions 38 and 40. Latch 42 is movable between a latching position outside of door 20 (see FIGS. 4 and 8) and an unlatching position retracted into door 20 (see FIG. 9).

Figure 4:
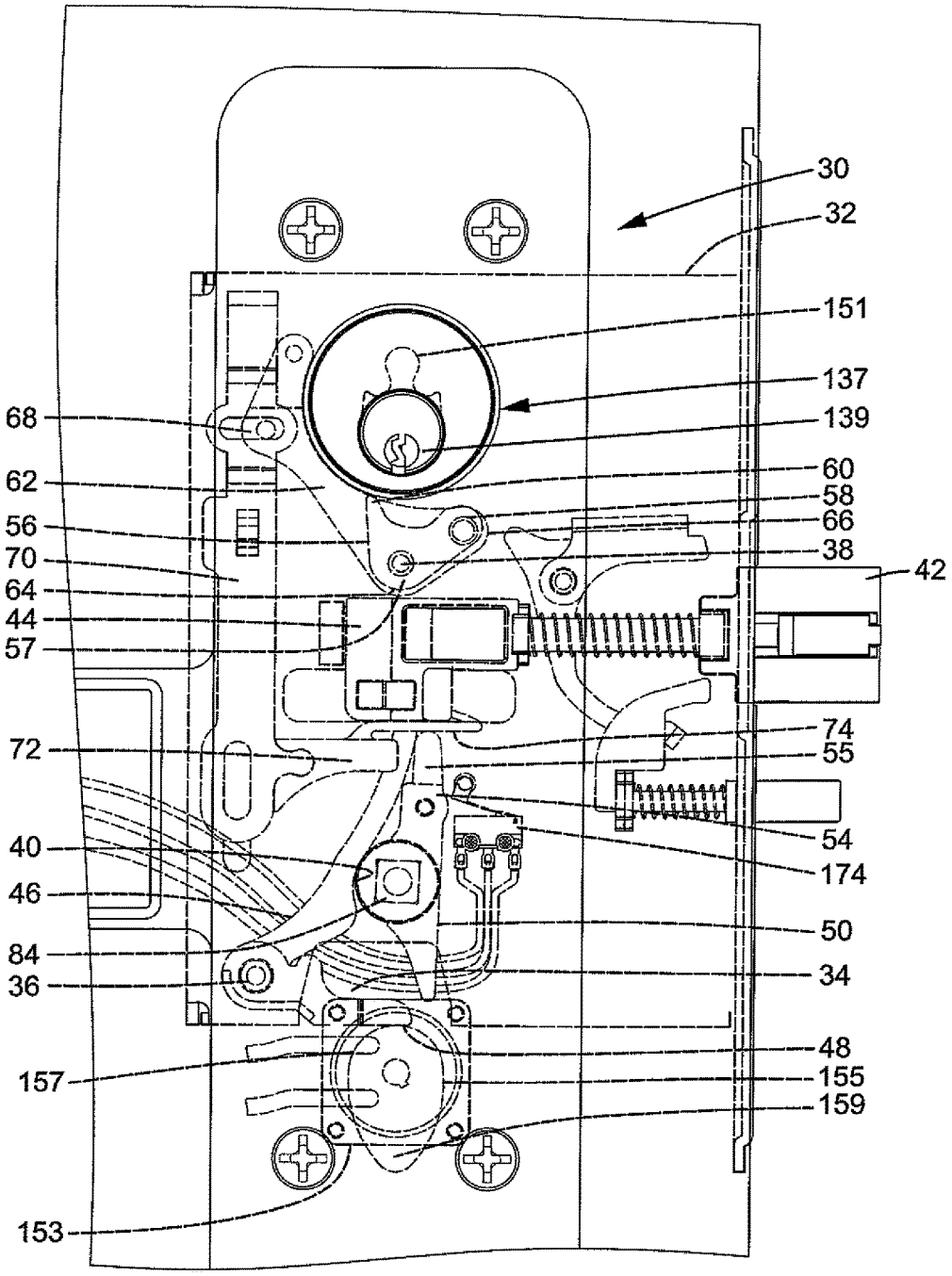
FIG. 4 is an enlarged view of a portion of the door lock of FIG. 3.

With reference to FIG. 4, latch device 30 further includes a pressing rod 48 mounted in casing 32 and pivotably connected to first pivotal portion 36. Latch device 30 further includes a push rod 46 mounted in casing 32 and having a distal end engaged with retractor 44. Retractor 44 and latch 42 move jointly when push rod 46 pivots (sec FIG. 9). Pressing rod 48 is located in opening 34 and has an end abutting push rod 46. Thus, push rod 46 is driven to pivot when pressing rod 48 pivots.

Latch device 30 further includes an unlatching member 50 pivotably connected to second pivotal portion 38, a transmission block 56 pivotably connected to and overlapped with third pivotal portion 40, and a rocker 62. Unlatching member 50 includes a push arm 54 abutting push rod 46. Unlatching member 50 further includes a recess 55 in a distal end of push arm 54. Transmission block 56 includes a pivotal portion 57 pivotably connected to third pivotal portion 40 and first and second ends 58 and 60 on two sides of pivotal portion 57. Rocker 62 includes a pivotal end 64 pivotably connected to third pivotal portion 40, an actuation end 66 securely connected to first end 58 of transmission block 56 to move therewith, and a push end 68 spaced from pivotal end 64 and actuation end 66. Rocker 62 can pivot about a pivotal axis defined by third pivotal portion 40.

Figure 3:
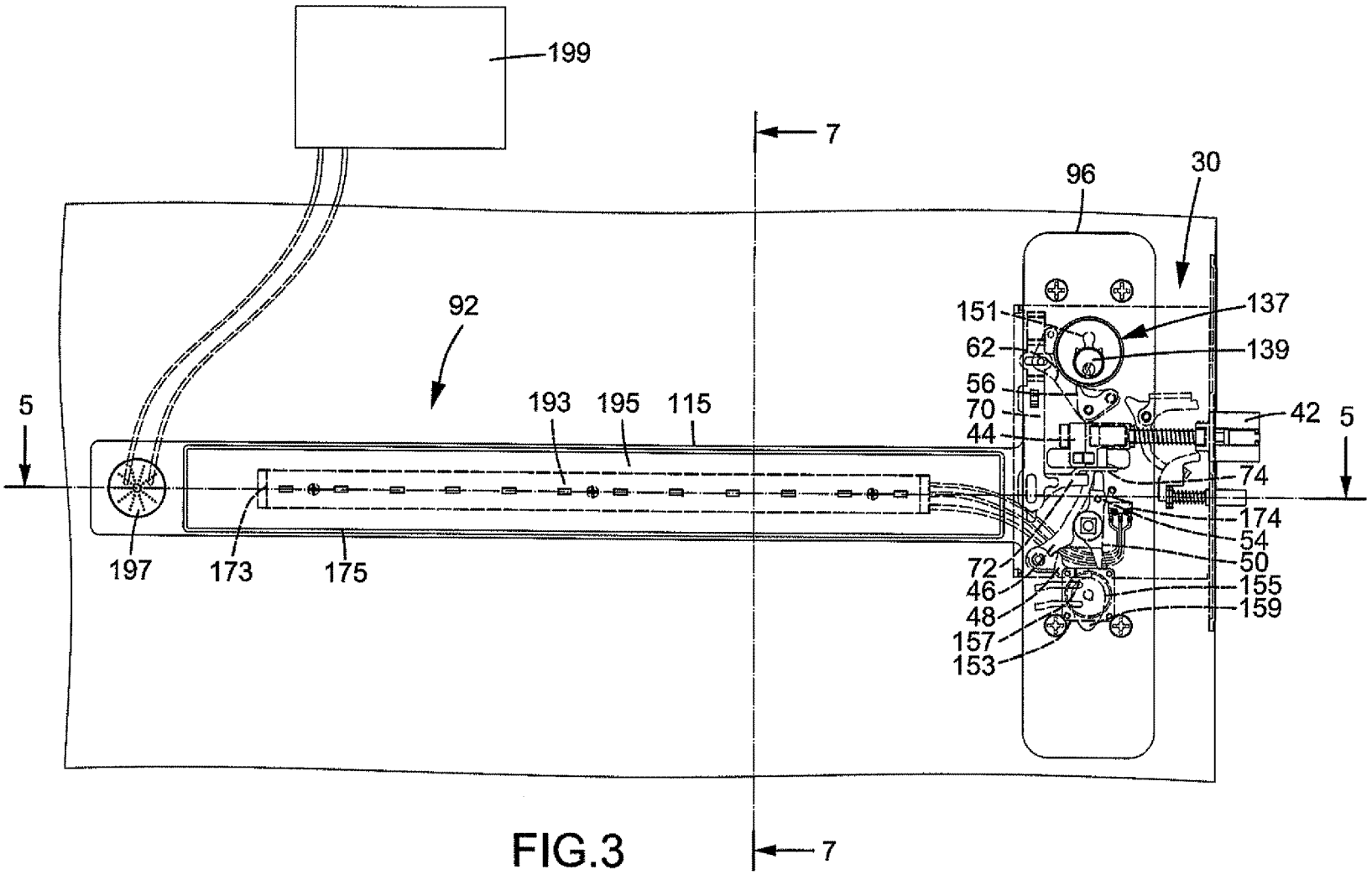
FIG. 3 is a front view of the door lock of FIG. 1.

Latch device 30 further includes a locking member 70 received in casing 32 and movable in the vertical direction. Locking member 70 includes a stopper portion 72 adjacent to unlatching member 50 and a pressing portion 74 extending from stopper portion 72. Push end 68 of rocker 62 and locking member 70 engage with each other to move jointly. Thus, when rocker 62 pivots about the pivotal axis defined by third pivotal portion 40, locking member 70 moves in the vertical direction between a locking position (FIG. 8) and a releasing position (FIGS. 3 and 4). When locking member 70 is in the releasing position, stopper portion 72 of locking member 70 is aligned with recess 55 of unlatching member 50, permitting unlatching member 50 to pivot and, thus, move latch 42. When locking member 70 is in the locking position, stopper portion 72 of locking member 70 is misaligned form recess 55 of unlatching member 50, preventing pivotal movement of unlatching member 50 and subsequent movement of latch 42.

With reference to FIG. 1, door lock 10 further includes an outer operating device 76 mounted to outer side 26 of door 20. Outer operating device 76 includes an outer escutcheon 78 and an outer handle 82 pivotably mounted to an outer side of outer escutcheon 78. Outer operating device 76 further includes a driving rod 84 engaged with outer handle 82 to move therewith. When outer handle 82 pivots, driving rod 84 is driven to pivot. Outer operating device 76 further includes a plurality of mounting posts 80 on an inner side of outer escutcheon 78 and an outer cylinder 86 fixed to outer escutcheon 78. Outer cylinder 86 includes an outer lock core 88 and an outer actuating member 90 fixed to a distal end of outer lock core 88. Outer lock core 88 can be locked and not rotatable. Nevertheless, outer lock core 88 can be unlocked by a key to become rotatable.

Outer escutcheon 78 of outer operating device 76 abuts outer side 26 of door 20. Driving rod 84 extends through outer side 26 of door 20 into casing 32 and engages with unlatching member 50 to move therewith (see FIG. 4). Each mounting post 80 extends into compartment 22 of door 20. Outer cylinder 86 extends through outer side 26 of door 20 into casing 32 and is located above rocker 62 and transmission block 56. When outer handle 82 is pivoted, unlatching member 50 is pivoted via transmission by driving rod 84, which, in turn, actuates push rod 46 to displace retractor 44, thereby moving latch 42 between the latching position and the unlatching position. Thus, when outer lock core 88 of outer cylinder 86 is rotated, outer actuating member 90 pushes first end 58 or second end 60 of transmission block 56 to actuate rocker 62, moving locking member 70 between the locking position and the releasing position.

Figure 5:
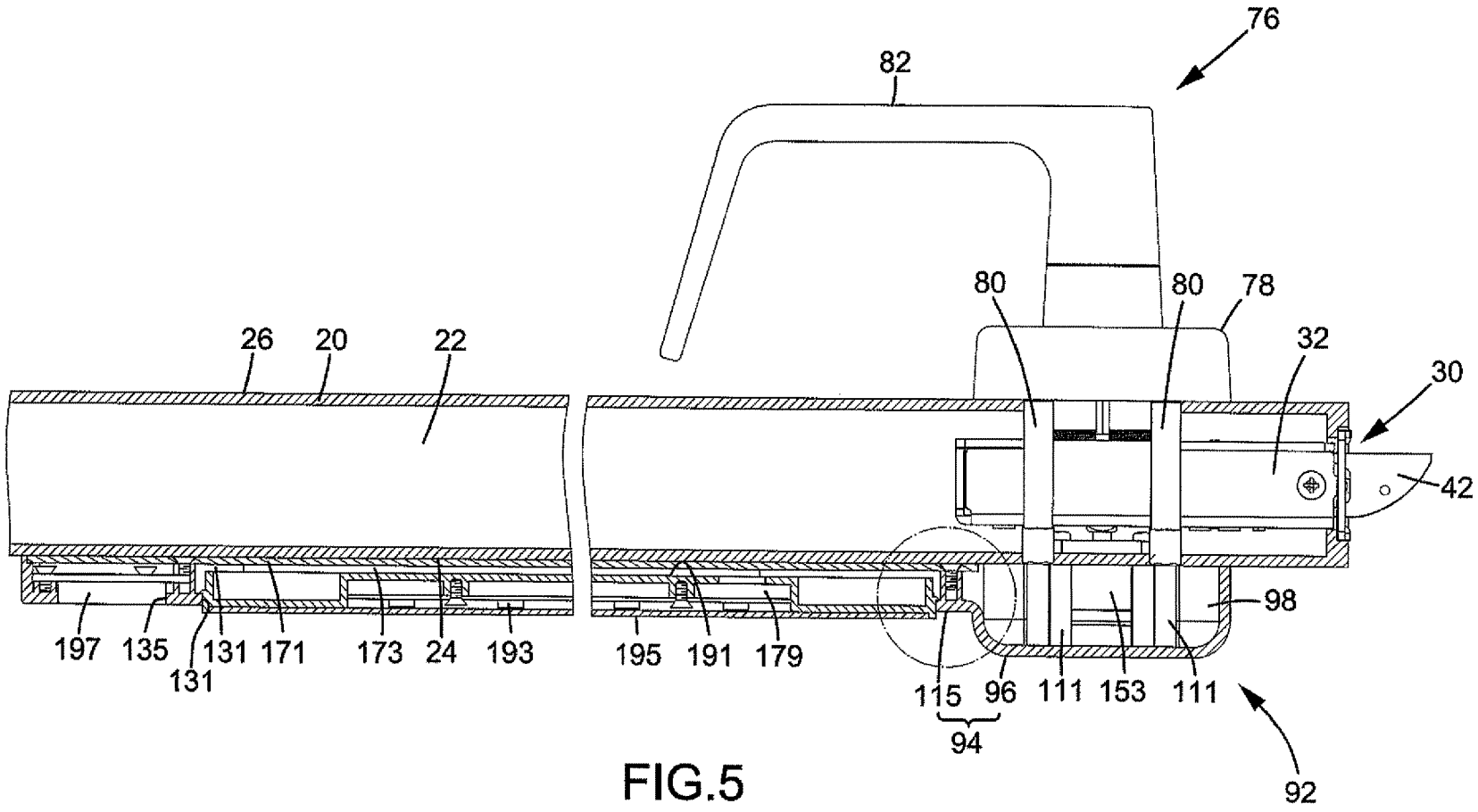
FIG. 5 is a cross sectional view taken along section line 5-5 of FIG. 3.
Figure 6:
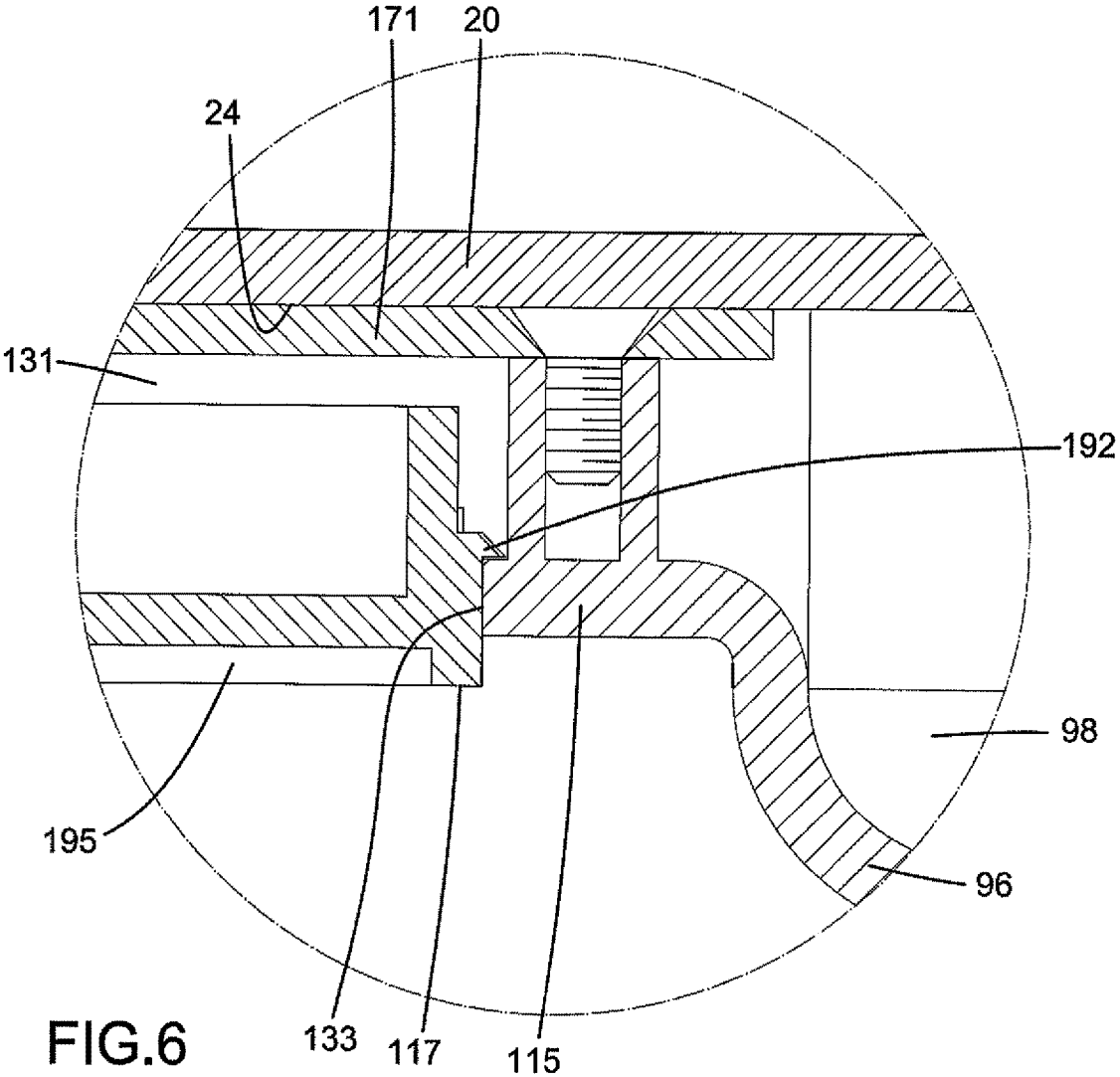
FIG. 6 is an enlarged view of a circled portion of the door lock of FIG. 5.
Figure 7:
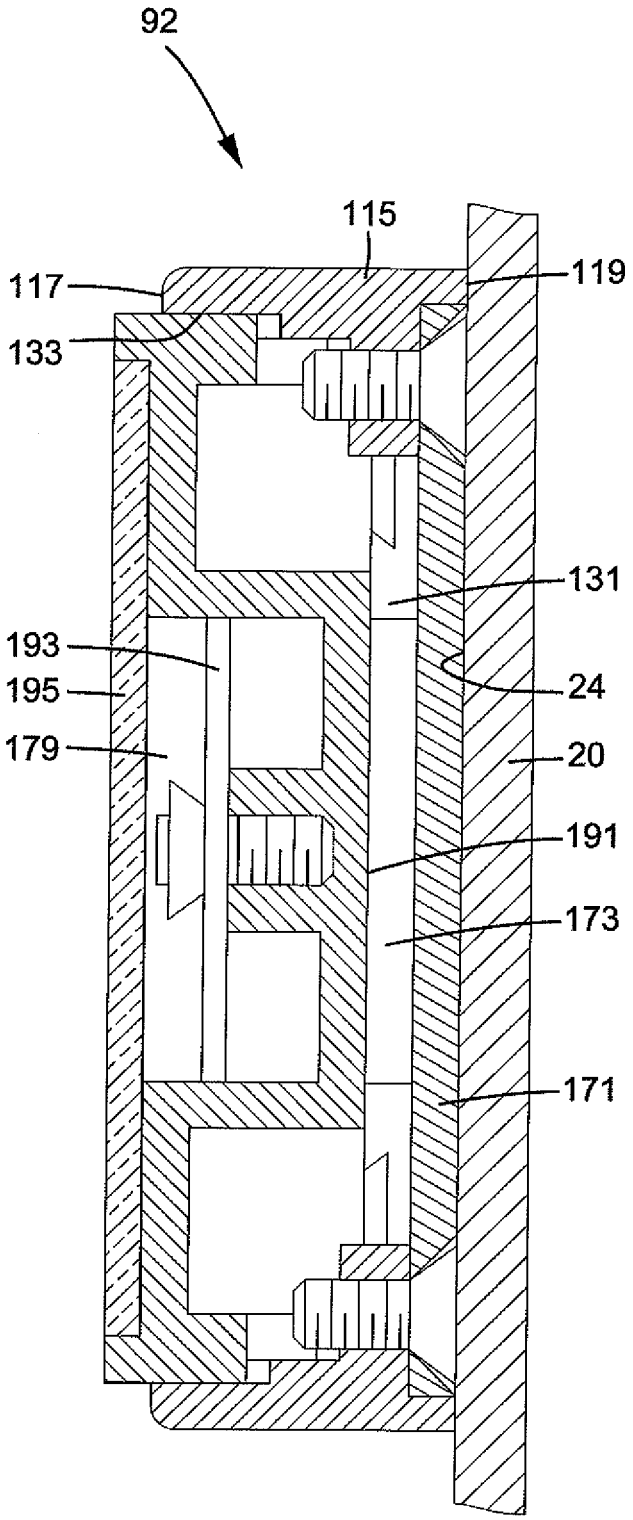
FIG. 7 is a cross sectional view taken along section line 7-7 of FIG. 3.

Door lock 10 further includes an inner operating device 92 according to the present invention. Inner operating device 92 includes a body 94 adapted to be mounted to inner side 24 of door 20. Body 94 includes a first section 96 extending in the vertical direction and a second section 115 extending from a side of first section 96 in the horizontal direction. First section 96 includes a first space 98 in an inner surface 119 thereof and a first engaging portion 111 formed an end face delimiting first space 98. First section 96 further includes a second engaging portion 113 at an outer surface of body 94 and intercommunicated with first space 98. Second section 115 includes an outer surface 117 and an inner surface 119 spaced from outer surface 117. Second section 115 includes a second space 131 in inner surface 119 and spaced from outer surface 117. Second section 115 further includes a first opening 133 defined in outer surface 117 and extending to second space 131 and a second opening 135 defined in outer surface 117 ad spaced from first opening 133. Body 94 abuts inner side 24 of door 20, and first section 96 is aligned with outer escutcheon 78 of outer operating device 76. Screws are extended through first section 96 of body 94 into mounting posts 80 of outer operating device 76. Thus, body 94 and outer operating device 76 are fixed to two sides of door 20 (see FIG. 5).

Inner operating device 92 further includes an electric driving device 153 mounted in the first space 98 of the body 94 and an inner cylinder 137. Inner cylinder 137 includes an inner lock core 139 and an inner actuating member 151 fixed to a distal end of inner lock core 139. Inner lock core 139 is configured to be in a first mode in which inner lock core 139 is locked and fixed or a second mode in which inner lock core 139 is unlocked and rotatable by a key. Inner cylinder 137 is fixed to second engaging portion 113 of first section 96 of body 94. An end of inner cylinder 137 with inner actuating member 151 extends through inner side 24 of door 20 into casing 32 and is located above transmission block 56 and rocker 62. When a key is used to unlock inner lock core 139, inner lock core 139 can be rotated to rotate inner actuating member 151 to press against transmission block 56, such that rocker 62 actuates locking member 70 to move between the locking position (FIG. 8) and the releasing position (FIG. 3).

Electric driving device 153 is received in first space 98 and is mounted to first engaging portion 111. Electric driving device 153 can be an electric motor. A driving member 155 is fixed to a shaft of electric driving device 153 and includes a releasing end 157 and a driving end 159. A spacing between releasing end 157 and a rotating axis of the shaft of electric driving device 153 is smaller than a spacing between driving end 159 and the rotating axis of the shaft of electric driving device 153. Thus, driving member 155 is substantially in the form of a cam. Driving member 155 is received in compartment 22 of door 20 and is located below pressing rod 48 of latch device 30 (FIG. 4). Furthermore, a peripheral face of driving member 155 abuts a bottom of pressing rod 48. Pivotal movement of driving member 155 causes movement of pressing rod 48 via releasing end 157 or driving end 159, thereby moving latch 42 between the latching position and the unlatching position (see FIGS. 4 and 9).

Inner operating device 92 further includes a cover 171 fixed to inner surface 119, a first detecting member 173 fixed to a side of cover 171, and an operating member 175 received in second space 131. Cover 171 is fixed between inner surface 119 of second section 115 and inner side 24 of door 20 by screws. First detecting member 173 is located in second space 131 and can be a pressure sensor of any desired form as conventional including but not limited to of a commercially available type. Alternatively, first detecting member 173 can be a microswitch.

Operating member 175 includes an outer side 177 having a groove 179. Operating member 175 further includes a pressing wall 191 acing first detecting member 173 and two hooked portions 192 on an outer periphery thereof. Electric driving device 153 is electrically connected to first detecting member 173. Operating member 175 is received in second space 131. Outer side 177 is located outside of second space 131. Each hooked portion 192 engages with first opening 133 of second section 115. Furthermore, pressing wall 191 abuts first detecting member 173.

A lighting device 193 is securely mounted in groove 179 of operating member 175 and includes a plurality of light emitting diodes. Furthermore, a light transmittable shield 195 is mounted to outer side 177 of operating member 175. Thus, the light generated by lighting device 193 can reach light transmittable shield 195.

With reference to FIG. 4, inner operating device 92 further includes a second detecting member 174 configured to be mounted in casing 32 of latch device. Second detecting member 174 is located below pressing portion 74 and is electrically connected to lighting device 193.

Inner operating device 92 further includes a broadcasting device 187 mounted in second space 131 of body 94 and located in second opening 135. Broadcasting device 197 is configured to be electrically connected to an anti-theft device 199 for detecting whether the indoor space is unexpectedly invaded, such as a magnetic field switch mounted between door 20 and a door frame, an infrared sensor mounted in the passageway, or similar electronic equipment. The power for driving electric driving device 153, lighting device 193, broadcasting device 197, and first and second detecting members 173 and 174 can be supplied by cells or other power supply.

Now that the basic construction of door lock 10 using inner operating device 92 has been explained, the operation and some of the advantages of door lock 10 can be set forth and appreciated. In particular, for the sake of explanation, it will be assumed that latch 42 is in the latching position, and locking member 70 is in the releasing position. In this state, unlatching member 50 is pivotable, and releasing end 157 of driving member 155 abuts pressing rod 48 (see FIGS. 3 and 4). In this case, if outer handle 82 of outer operating device 76 is pivoted, driving rod 84 actuates push arm 54 of unlatching member 50 to push the push rod 46 to thereby press against retractor 44, moving latch 42 from the latching position to the unlatching position. When outer handle 82 is released while latch 42 is in the unlatching position, latch 42 and retractor 44 return to their original position under the action of a spring.

If a key is used to release the locking state of outer lock core 88 of outer cylinder 86, the key can be used to rotate outer lock core 88, such that outer actuating member 90 presses against second end 60 of transmission block 56. Thus, transmission block 56 pivots, and first end 58 of transmission block 56 actuates rocker 62 to pivot, moving locking member 70 from the releasing position (see FIG. 3, door lock 10 is in the locked state) to the locking position (see FIG. 8, door lock 10 is in the unlocked state). In this case, pressing portion 74 of locking member 70 presses against second detecting member 174, and second detecting member 174 outputs a signal to lighting device 193. As a result, lighting device 183 emits light that reaches light transmittable shield 195. A user can judge by the light from lighting device 193 to conclude that door lock 10 is locked (latch 42 cannot be moved to the unlatching position by operating outer handle 82 of outer operating device 76). When locking member 70 is in the locking state, stopper portion 72 of locking member 70 is misaligned from recess 55 of unlatching member 50. Thus, the pivotal path of unlatching member 50 is impeded by stopper portion 72 of locking member 70, and outer handle 82 of outer operating device 76 cannot be pivoted. Consequently, latch 42 cannot be moved to the unlatching position by operating outer handle 82 of outer operating device 76.

Figure 9:
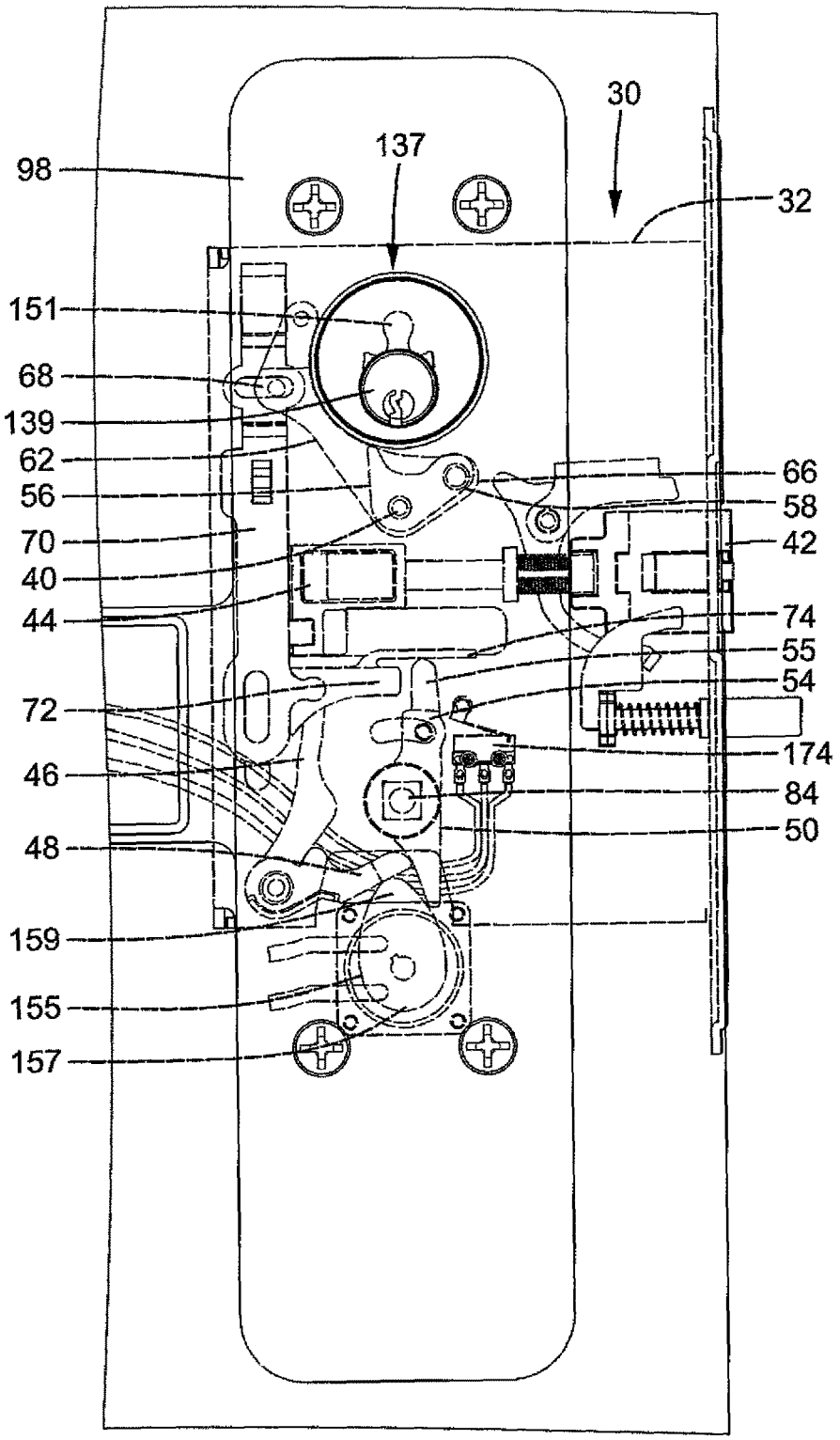
FIG. 9 is a view similar to FIG. 4, with an operating member pressed to activate an electric driving device to thereby move a latch to an unlatching position.

No matter locking member 70 is in the locking position or the releasing position, when operating member 175 is applied with a force from the inner side of door 20, operating member 175 presses against first detecting member 173, such that first detecting member 173 outputs a signal controlling electric driving device 153 to operate. Driving member 155 pivots from an angular position (in which releasing end 157 abuts pressing rod 48) to another angular position in which driving end 159 presses against pressing rod 48. Pressing rod 48 pressed by driving member 155 drives push rod 46 to pivot, which, in turn, actuates retractor 44, moving latch 42 from the latching position (FIG. 3) to the unlatching position (FIG. 9).

If locking member 70 is in the releasing state, when a key is used to unlock inner lock core 139 of inner cylinder 137 and to rotate inner lock core 139, inner actuating member 151 presses against second end 60 of transmission block 56, such that locking member 70 is pushed by rocker 62 to move from the releasing position to the locking position. Second detecting member 174 is pressed by pressing portion 74 of locking member 70, and lighting device 193 of inner operating device 92 emits light that reaches light transmittable shield 195.

On the other hand, if locking member 70 is in the locking state, when a key is used to unlock inner lock core 139 of inner cylinder 137 or outer lock core 88 of outer cylinder 86, inner actuating member 151 or outer actuating member 90 is moved to press against first end 58 of transmission block 56, returning transmission block 56 through pivotal movement. At the same time, rocker 62 actuates locking member 70 to move from the locking position (FIG. 8) to the releasing position (FIGS. 3 and 4). Thus, pressing portion 74 of locking member 70 releases second detecting member 174, and the second detecting member 174 will not output signal to lighting device 193. As a result, lighting device 193 stops emitting light.

Inner operating device 92 can indicate door lock 10 is set to be in the locked state or unlocked state by causing lighting device 193 to emit light or not to emit light. Thus, the problem of the prior art (unable to judge the door lock is in the locked state or the unlocked state by the inner operating device) is solved.

Furthermore, the electric design of inner operating device 92 greatly reduces the complexity and the number of parts of the mechanical structure, effectively reducing the manufacturing costs.

Now that the basic teachings of the present invention have been explained, many extensions and variations will be obvious to one having ordinary skill in the art. For example, in addition to an electric motor, electric driving device 153 can be an electromagnetic valve of any desired form as conventional including but not limited to of a commercially available type. In this case, inner operating device 153 does not have to include driving member 155, and pressing rod 48 of latch device 30 can be pivoted by the shaft of the electromagnetic valve through electrification or non-electrification of the electromagnetic valve, which can also move latch 42 between the latching position and the unlatching position.

In addition to using lighting device 193 that emits light or not emits light to indicate the locked state or the unlocked state of door lock 10, inner operating device 92 can also use lighting device 193 to emit light of different colors to achieve the same function. For example, when door lock 10 is set to be in the locked state, lighting device 193 emits red light that reaches light transmittable shield 195. On the other hand, when door lock 10 is set to be in the unlocked state, lighting device 193 emits green light that reaches light transmittable shield 195. In an alternative example, lighting device 193 does not emit light when door lock 10 is set to be in the locked state, and lighting device 193 emits light when door lock 10 is set to be in the unlocked state.

Furthermore, door lock 10 can use outer operating device 76 of another type. For example, outer operating device 76 can be comprised of an outer cylinder 86 and a fixed handle, both of which are mounted to outer side 26 of door 20. A key can be used to unlock outer lock core 88 of outer cylinder 86 for permitting use of outer cylinder 86 for the purposes of moving latch 42 of a latch device from the latching position to the unlatching position. An example of the latch device is disclosed U.S. Pat. No. 8,641,104, the entire contents of which are incorporated herein by reference.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. An inner operating device for a door lock, with the door lock including a latch device mounted in a compartment of a door, with the latch device including a latch movable between a latching position and an unlatching position, with the latch device further including a locking member movable between a locking position and a releasing position, with the latch being movable from the latching position to the unlatching position when the locking member is in the releasing position, with the latch being prevented from moving from the latching position to the unlatching position when the locking member is in the locking position, with the inner operating device comprising:

a body adapted to be mounted to an inner side of the door, with the body including a first section and a second section, with the first section including a first space in an inner side thereof and a first engaging portion formed in the first space, with the second section including a second space;

an electric driving device received in the first space of the body and mounted to the first engaging portion, with the electric driving device configured to be operably connected to the latch of the latch device;

a first detecting member mounted in the second space of the body and electrically connected to the electric driving device;

a second detecting member configured to be mounted in the latch device, with the locking member pressing against the second detecting member when the locking member is in one of the releasing state and the locking state, and with the locking member not pressing against the second detecting member when the locking member is in another of the releasing state and the locking state;

an operating member mounted in the second space of the body and partially exposed outside of the second section, with the operating member including a groove, and with the operating member abutting the first detecting member;

a lighting device received in the groove of the operating member, with the lighting device electrically connected to the second detecting member;

with the operating member not pressed by an external force, the operating member does not press against the first detecting member, the electric driving device is not activated, and the latch remains in the latching position, with the operating member pressed by an external force, the operating member presses against the first detecting member, the electric driving device is activated, and the latch is moved from the latching position to the unlatching position, with the locking member in the locking state, the lighting device is in one of a first state emitting light and a second state not emitting light, and with the locking member in the releasing state, the lighting device is in another of the first state emitting light and the second state not emitting light.

2. The inner operating device for a door lock as claimed in claim 1, wherein the first detecting member is a pressure sensor.

3. The inner operating device for a door lock as claimed in claim 1, with the second section of the body including a first opening intercommunicated with the second space and a second opening spaced from the first opening, with the operating member located in the first opening, with the inner operating device further comprising: a broadcasting device mounted in the second space of the body and located in the second opening, with the broadcasting device configured to be electrically connected to an anti-theft device, wherein when the anti-theft device is activated, the broadcasting device generates an audio alarm, and wherein when the anti-theft device is not activated, the broadcasting device does not generate the audio alarm.

4. The inner operating device for a door lock as claimed in claim 3, with the operating member including two hooked portions on an outer periphery thereof, and with each of the two hooked portions engaged with the first opening of the body.

5. The inner operating device for a door lock as claimed in claim 1, further comprising a driving member coupled with the electric driving device, with the driving member including a releasing end and a driving end, with the electric driving device operably connected to the latch via the driving member, with the electric driving device driving the driving end of the driving member to move the latch from the latching position to the unlatching position or driving the releasing end of the driving member to move the latch from the unlatching position to the latching position.

6. The inner operating device for a door lock as claimed in claim 1, with the first section of the body further including a second engaging portion intercommunicated with the first space, with the inner operating device further comprising: an inner cylinder including an inner lock core and an inner actuating member fixed to the inner lock core to move therewith, with the inner lock core configured to be in a first mode in which the inner lock core is locked and fixed or a second mode in which the inner lock core is unlocked and rotatable, with the inner actuating member jointly movable with the locking member, wherein when the inner lock core is unlocked, the inner actuating member is permitted to actuate the locking member to move between the locking position and the releasing position.

7. An inner operating device for a door lock, with the door lock including a latch device mounted in a compartment of a door, with the latch device including a latch movable between a latching position and an unlatching position, with the latch device further including a locking member movable between a locking position and a releasing position, with the latch being movable from the latching position to the unlatching position when the locking member is in the releasing position, with the latch being prevented from moving from the latching position to the unlatching position when the locking member is in the locking position, with the inner operating device comprising:

a body adapted to be mounted to an inner side of the door, with the body including a first section and a second section, with the first section including a first space in an inner side thereof and a first engaging portion formed in the first space, with the second section including a second space;

an electric driving device received in the first space of the body and mounted to the first engaging portion, with the electric driving device configured to be operably connected to the latch of the latch device;

a first detecting member mounted in the second space of the body and electrically connected to the electric driving device;

a second detecting member configured to be mounted in the latch device, with the locking member pressing against the second detecting member when the locking member is in one of the releasing state and the locking state, and with the locking member not pressing against the second detecting member when the locking member is in another of the releasing state and the locking state;

an operating member mounted in the second space of the body and partially exposed outside of the second section, with the operating member including a groove, and with the operating member abutting the first detecting member;

a lighting device received in the groove of the operating member, with the lighting device electrically connected to the second detecting member;

with the operating member not pressed by an external force, the operating member does not press against the first detecting member, the electric driving device is not activated, and the latch remains in the latching position, with the operating member pressed by an external force, the operating member presses against the first detecting member, the electric driving device is activated, and the latch is moved from the latching position to the unlatching position, with the locking member in the locking state, the lighting device emits light of a first color, and with the locking member in the releasing state, the lighting device emits light of a second color different from the first color.

8. The inner operating device for a door lock as claimed in claim 7, wherein the first detecting member is a pressure sensor.

9. The inner operating device for a door lock as claimed in claim 7, with the with the second section of the body including a first opening intercommunicated with the second space and a second opening spaced from the first opening, with the operating member located in the first opening, with the inner operating device further comprising: a broadcasting device mounted in the second space of the body and located in the second opening, with the broadcasting device configured to be electrically connected to an anti-theft device, wherein when the anti-theft device is activated, the broadcasting device generates an audio alarm, and wherein when the anti-theft device is not activated, the broadcasting device does not generate the audio alarm.

10. The inner operating device for a door lock as claimed in claim 9, with the operating member including two hooked portions on an outer periphery thereof, and with each of the two hooked portions engaged with the first opening of the body.

11. The inner operating device for a door lock as claimed in claim 7, further comprising a driving member coupled with the electric driving device, with the driving member including a releasing end and a driving end, with the electric driving device operably connected to the latch via the driving member, with the electric driving device driving the driving end of the driving member to move the latch from the latching position to the unlatching position or driving the releasing end of the driving member to move the latch from the unlatching position to the latching position.

12. The inner operating device for a door lock as claimed in claim 7, with the first section of the body further including a second engaging portion intercommunicated with the first space, with the inner operating device further comprising: an inner cylinder including an inner lock core and an inner actuating member fixed to the inner lock core to move therewith, with the inner lock core configured to be in a first mode in which the inner lock core is locked and fixed or a second mode in which the inner lock core is unlocked and rotatable, with the inner actuating member jointly movable with the locking member, wherein when the inner lock core is unlocked, the inner actuating member is permitted to actuate the locking member to move between the locking position and the releasing position.

* * * * *